United States Patent [19]

Habluetzel

[11] Patent Number: 4,502,384

[45] Date of Patent: Mar. 5, 1985

[54] METHOD AND DEVICE FOR CHANGING PRINTING ELEMENTS IN A PRINTING UNIT OF A PRESS

[75] Inventor: Hans Habluetzel, Echandens, Switzerland

[73] Assignee: Bobst SA, Lausanne, Switzerland

[21] Appl. No.: 491,524

[22] Filed: May 4, 1983

[30] Foreign Application Priority Data

May 6, 1982 [CH] Switzerland ..... 2913/82

[51] Int. Cl.[3] ..... B41F 9/00

[52] U.S. Cl. ..... 101/153; 101/216

[58] Field of Search ..... 101/152–153, 101/178–182, 216, 219, 247, 350–351, 185

[56] References Cited

U.S. PATENT DOCUMENTS

| | | | |
|---|---|---|---|
| 2,506,011 | 5/1950 | Caulfield | 101/153 X |
| 2,676,538 | 4/1954 | Bamford | 101/153 |
| 3,173,360 | 3/1965 | Hamilton | 101/216 X |
| 3,500,744 | 3/1970 | Lewis | 101/153 X |
| 3,555,934 | 1/1971 | Merino | 101/316 |
| 3,625,145 | 12/1971 | Heatley, Jr. | 101/152 |
| 3,783,782 | 1/1974 | Hardt | 101/216 |
| 3,789,757 | 2/1974 | Motter et al. | 101/216 X |
| 3,876,087 | 4/1975 | Osta | 101/216 |
| 4,046,070 | 9/1977 | Halley | 101/153 X |
| 4,137,843 | 2/1979 | Ottenhue | 101/153 |
| 4,413,541 | 11/1983 | Biggar | 101/153 X |

FOREIGN PATENT DOCUMENTS

| | | | |
|---|---|---|---|
| 1081476 | 5/1960 | Fed. Rep. of Germany | 101/152 |
| 2421099 | 11/1975 | Fed. Rep. of Germany | 101/153 |
| 1077444 | 11/1954 | France | 101/216 |
| 280804 | 2/1952 | Switzerland | 101/216 |
| 895125 | 5/1962 | United Kingdom | 101/152 |
| 1003887 | 9/1965 | United Kingdom | 101/178 |

*Primary Examiner*—E. H. Eickholt

*Attorney, Agent, or Firm*—Hill, Van Santen, Steadman & Simpson

[57] ABSTRACT

A method and apparatus for changing printing elements in each of the printing units of a printing press. In one embodiment the device includes a table composed of individual plates with a lifting arrangement for each of the individual plates, and the table, which is positioned underneath the press with two plates for each unit, has means for shifting the table between a first position with one of the plates being disposed under the unit to a second position with the other plate positioned underneath the unit so that a new carriage can be moved underneath the unit as an old carriage is removed.

9 Claims, 17 Drawing Figures

FIG. 16
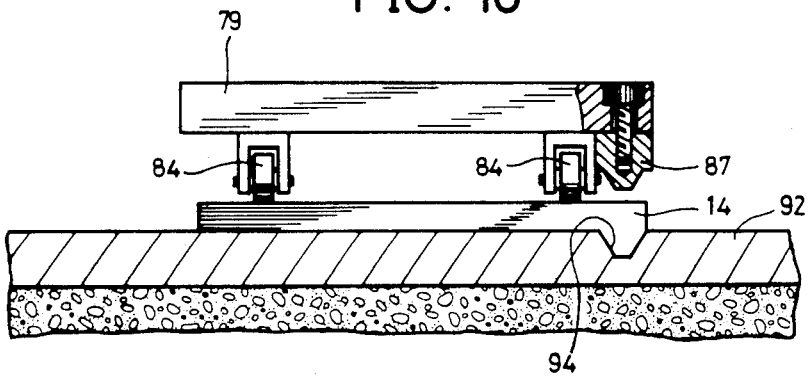
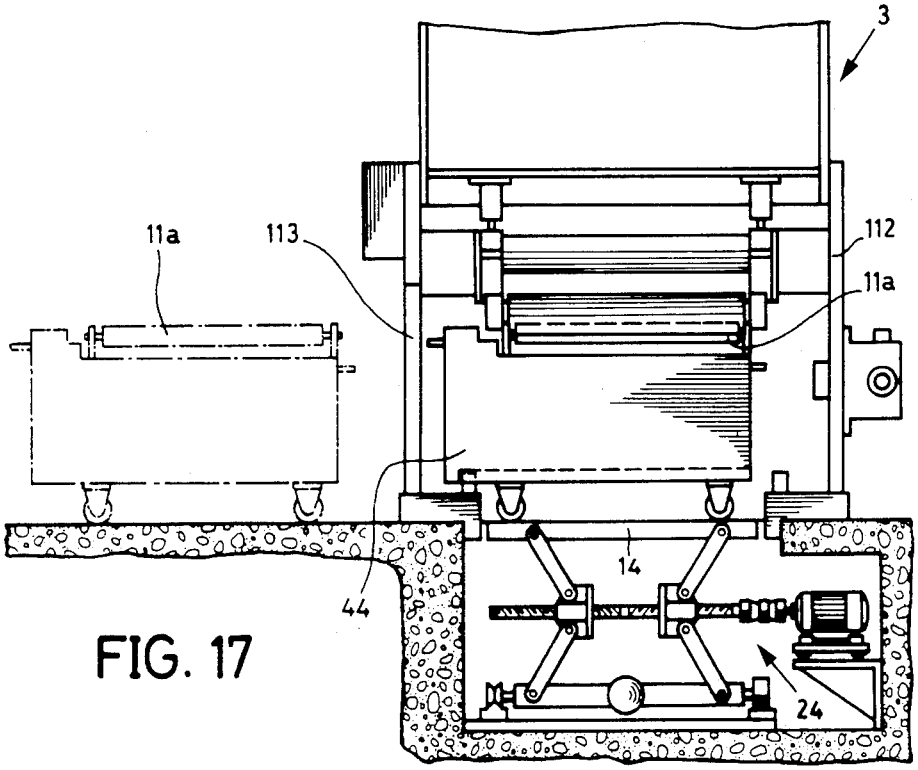
FIG. 17

METHOD AND DEVICE FOR CHANGING PRINTING ELEMENTS IN A PRINTING UNIT OF A PRESS

BACKGROUND OF THE INVENTION

The present invention is directed to a method and apparatus for changing printing members such as pressure rolls and engraved cylinders for each printing unit of a printing press.

Printing presses known heretofore generally include a feeding unit with a web unwinding arrangement and a feeding arrangement which feeding unit is then followed by several printing units each of which will print a different color according to the particular job which is to be done. For instance to produce a print having multiple colors, the press may print white in the first printing unit, the second printing unit will print a yellow color, a third unit will print red, a fourth unit will print blue and a fifth unit will print black. These printing presses are able to execute various kinds of printing and when one print is stopped another may be started; however, the order of colors in the various printing units might need to be completely changed. Sometimes, one or more units are taken out of the order. If the colors are arranged differently, the printing members or elements have to be cleaned and provided with new ink with the color of the ink being adjusted to the new job that is being started. In that case, one might use several sets of printing elements so that the operator introduced already prepared elements into the press or machine. Thus the machine keeps running while the previously used printing elements are cleaned. Of course, the machine has to be stopped while the printing elements are changed usually two elements have to be replaced these are the engraved printing cylinder and its inking device which are mounted together on a first carriage and the separate pressure roller. To remove the pressure roller from its position in the printing unit, it is first mounted on a trolley to enable it removable. The machine described hereinbefore requires the removal and replacement of the carriage supporting the engraved cylinder and the removal of the pressure rolls for each of the five printing units. This operation can last a long time and evidently requires the standstill of the printing press.

SUMMARY OF THE INVENTION

The present invention is directed to providing a method and device for handling the various printing elements of the printing units which method and device avoid the inconveniences of the known procedures and appreciably reduces the standstill or down time of the press during the exchanging of the printing elements.

To accomplish these goals, the method for changing the printing elements and the printing units of a press having at least two printing units spaced apart a distance A, each unit receiving a carriage supporting a printing cylinder and having an opening enabling access to a pressure roll of the unit, the method comprising providing the printing press with a movable table having two plates for each unit, each of said plates being mounted on the table with means for moving in a vertical direction between an upper position and a lower position, said table having means for reciprocally moving it along a path at least a distance equal to one-half of the spacing A between the units; placing carriages containing the new engraved cylinders on each of the tables not disposed in the printing units; stopping the press; lifting each of the plates from a lower level to the upper level; shifting the table with the lifted plates in a first direction by a distance one-fourth A to clear each of the openings of the units; lowering the plates to the lower level; inserting an empty trolley through each of the openings of each unit to receive and support the pressure roll therein; removing the trolley with the pressure roll supported thereon; inserting a new trolley containing a new pressure roll through each of the openings to position the roll for engagement in the printing unit; engaging the new pressure roll in the unit and subsequently removing the empty trolley; again lifting each of the plates to the upper level; shifting the table in the first direction one-fourth the distance A between the units to position a new carriage containing the new printing cylinder in each of the units; lowering each of the plates to the lower position to engage the new carriage in the unit.

If desired, the carriages containing the first mentioned elements can be laterally removed from the printing device to be cleaned or further processed. Also, the plates, while in the lower unit and free of carriages, can be shifted in either direction without disturbing the carriage in each unit.

The device for performing the invention of the method has at least a table having for each unit two positions for receiving a carriage; means for shifting the table to present or align each position with the unit; means for disengaging each of the carriages positioned in the printing unit to be able to move with the table. In one embodiment, the table is composed of a plurality of plates with each plate being individually liftable between a lower position and an upper position which upper position lifts the carriage from engagement on positioning stops of the printing unit. In another embodiment, the table is a single unit positioned parallel to the printing press having a position for each of the carriages, the carriages are disengaged from each unit and moved onto the table which then shifts to present a new carriage for positioning in the printing unit. In a third embodiment, each unit has a movable table having two positions and movable in a direction perpendicular to the feed of the strip through the printing press, means are provided for locking each of the tables in each position to present or lock a carriage in the printing unit.

In the first embodiment, the means for raising and lowering the table preferably utilize a toggle arrangement to be discussed in greater detail hereinafter.

BRIEF DESCRIPTION OF THE DRAWINGS

FIG. 2 is illustrating the device of FIG. 1 with a movement in a first direction of one-fourth of the spacing between the units;

FIG. 3 is complete movement of the exchanging mechanism with the table in the elevated position;

FIG. 4 illustrates final insertion of the new units with the old units being removed from the press;

FIG. 5 shows moving the changing mechanism to the beginning position;

FIG. 6 illustrates utilizing the changing mechanism of the present invention for changing a single carriage of the press with that single mechanism being lifted to an elevated position;

FIG. 7 shows shifting of the changing mechanism to remove the single carriage from the unit;

FIG. 8 illustrates the removed carriage in a lower position;

FIG. 9 illustrates the changing mechanism in the lower position at a spacing of one-fourth the distance between the units;

FIG. 16 is a cross-sectional view taken along the lines XVI—XVI of FIG. 13; and

FIG. 17 is a diagrammatical transverse cross-sectional view illustrating a trolley in a position for removing the pressure rolls.

DESCRIPTION OF THE PREFERRED EMBODIMENTS

Figure 1:
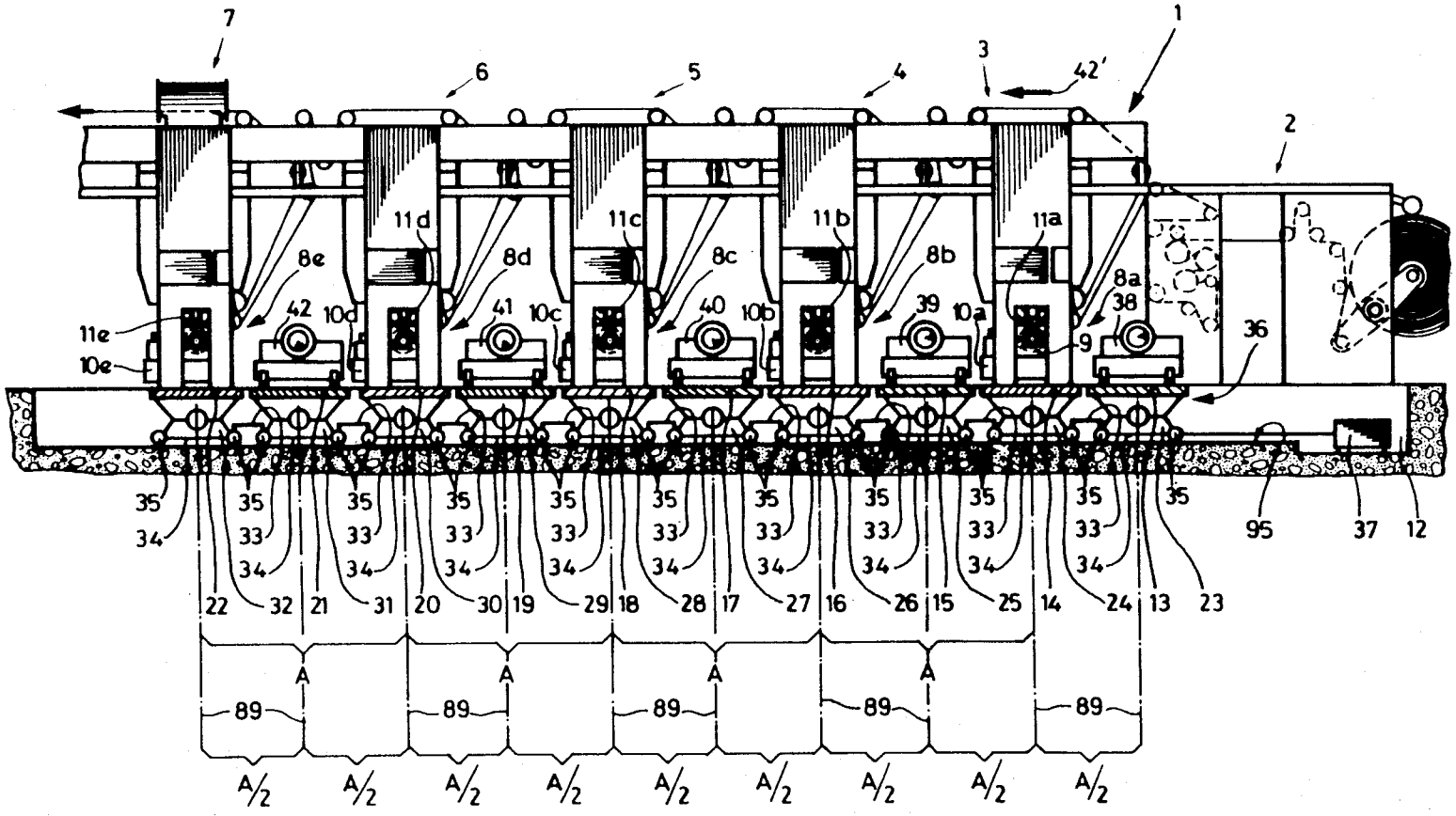
FIGS. 1–9 are each longitudinal cross-sectional views with portions in elevation schematically illustrating a side of a printing press in accordance with the present invention with an embodiment of a device for changing various carriages containing the printing cylinders with FIG. 1 illustrating the beginning with a new set of carriages containing a set of printing cylinders positioned to begin a changing operation.

The principles of the present invention are particularly useful when incorporated in a printing press generally indicated 1 in FIG. 1. The printing press 1 has a feeding station 2 followed by a successive printing units 3, 4, 5, 6 and 7. Each of the printing units is separated from adjacent units by a distance measured between the respective axes and indicated at A. Each of the printing units includes printing members 8*a*, 8*b*, 8*c*, 8*d* and 8*e* comprising on the one hand engraved cylinders 9, mounted with an inking element on a support carriage such as 10*a*, 10*b*, 10*c*, 10*d* or 10*e* and on the other hand pressure rolls 11*a*, 11*b*, 11*c*, 11*d* and 11*e* which are mounted in each of the units.

The press 1 is positioned on the ground level over a pit 12, which is as shallow as possible and which contains a table arrangement 36 which is formed by a plurality of plates 13–22. Each of the plates 13–22 is mounted by a lifting means 23–32 which lifting means each have a base member 34 which are interconnected by stirrup elements or members 33 to form the table 36. Each of the lifting means 23 to 35 on its sole or base member 34 is provided with rollers 35 which are received on a guiding plane 95 arranged in the bottom of the pit 12. The table 36 is movable back and forth in a first direction 42′ and in the opposite direction to the direction 42′ by a controlled drive device 37 which can be, for example, a double action pneumatic piston or a chain system driven by an electric motor which is reversible. The spacing between the axis of each of the plates 13–22 is equivalent to one-half of the distance between the axis of two successive printing units and thus A/2.

As best illustrated in FIG. 1, each of the printing members 8*a*–8*e* are positioned in the respective units 3–7 and are to be removed after the particular printing job is completed. To that aim, while the press is still running to finish the job, carriages 38–42 which support a new set of engraved cylinders and inking elements are shifted onto the plates 13, 15, 17, 19 and 23 and as illustrated are positioned ahead of the printing units 3–7 when taken in the direction of movement of the web through the units which is indicated by an arrow 42′. After positioning the carriages 38–42 on the repective plates as illustrated in FIG. 1, the machine can be stopped as soon as the particular printing task has been finished.

Figure 2:
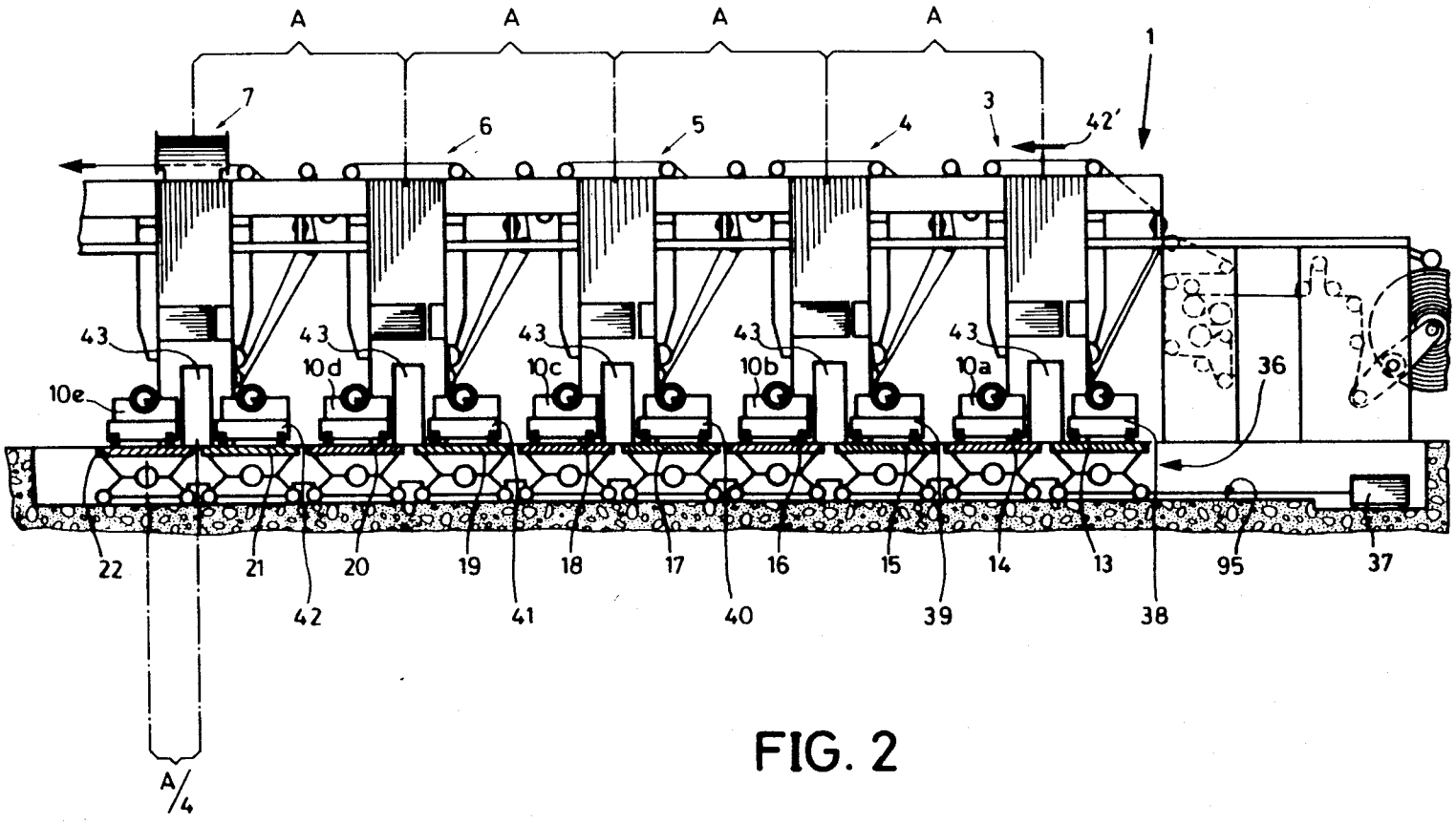
Figure 3:
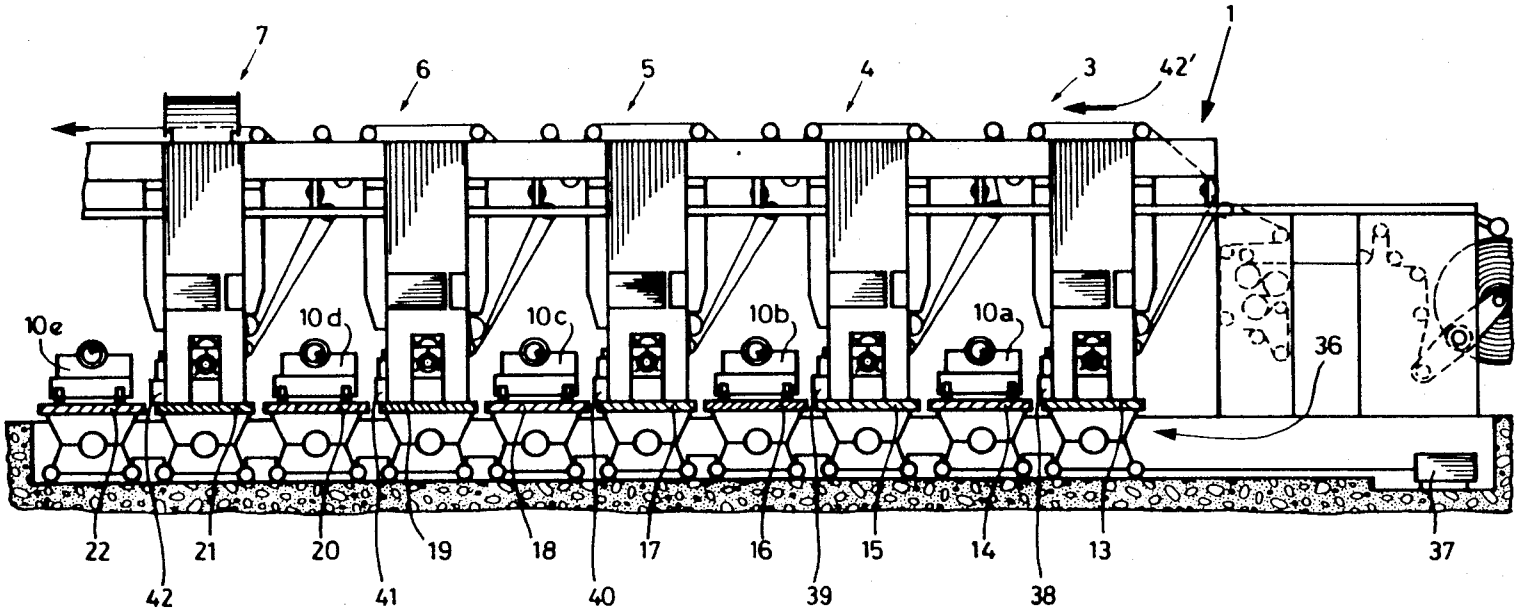

After stopping the machine, all of the plates 13–22 are lifted to an upper position illustrated in FIG. 3 to disengage each of the carriages 10*a*, 10*b*, 10*c*, 10*d* and 10*e* from their respective printing units 3–7. While in the elevated position, the table 36 is shifted in the first direction which is the same as the arrow 42′ by a distance one-fourth of the distance A separating the printing units so that each of the plates 13–22 is shifted a distance A/4. After shifting this distance A/4, the plates are then lowered again to their initial or lower level as illustrated in FIG. 2. In this position, an aperture or opening 43 of each of the printing units 3–7 is clear of the carriages so that a trolley 44 can be inserted into the aperture 43 as illustrated in FIG. 17 to receive the old pressure rolls and to aid in replacing each of the old pressure rolls 11*a*–11*e*. This is accomplished by an empty trolley being inserted through the opening 43 to a position where a pressure roll such as 11*a* can be received and engaged. After the pressure roll is received and engaged on the trolley, the trolley is moved out of the printing unit 3 to a broken line position illustrated in FIG. 17. After being removed from the unit, a new trolley is inserted carrying the new pressure roll is inserted to position the new roll in the machine for mounting. After mounting the new pressure roll, the trolley is now removed.

Figure 4:
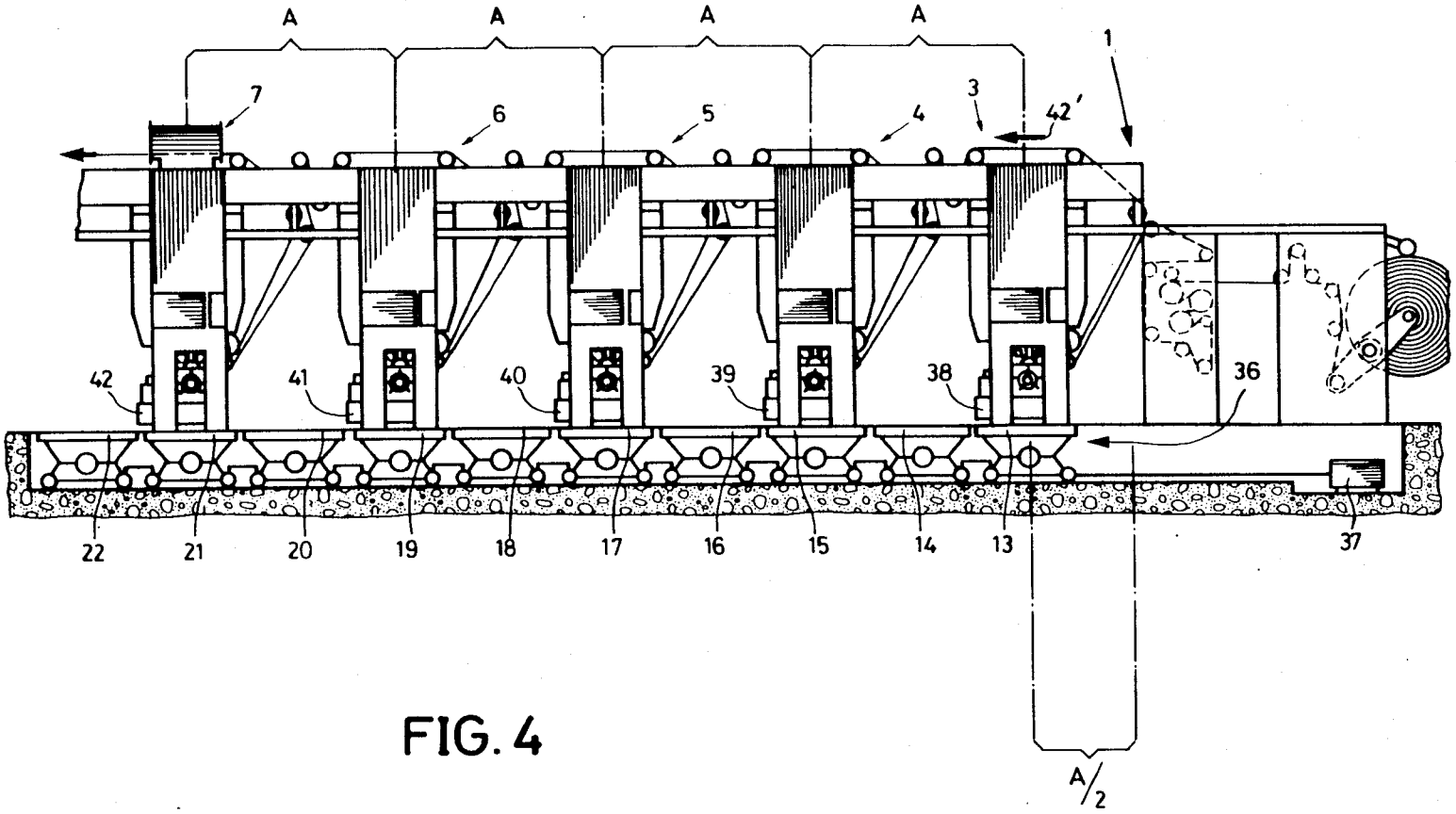
Figure 5:
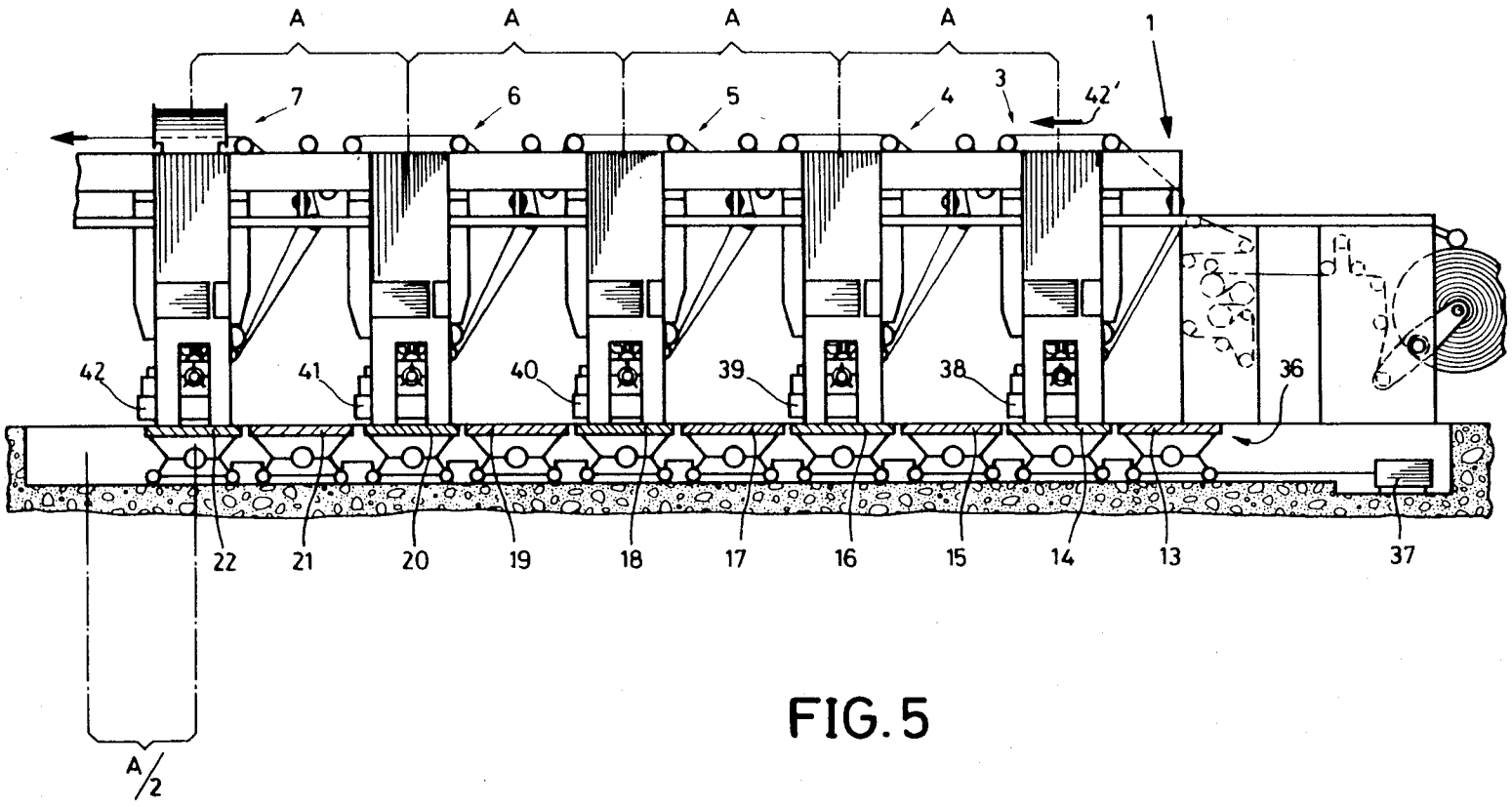

After the pressure rolls have been exchanged, the plates 13–22 are again lifted to the upper level (FIG. 3) and the table 36 is shifted at another distance A/4 in the direction of arrow 42′ so that the carriages 10*a*–10*e* are completely removed from the machines and the carriages 38–42 supporting the new set of engraved cylinders are positioned as shown in FIG. 3. The plates 13–22 are then lowered to the lower level which causes the carriages 38–42 to be positioned in each of the units 3–7. While in the lower level, the carriages 10*a*–10*e* can be removed from the plates 14, 16, 18, 20 and 22 of the table 36 as illustrated in FIG. 4. In this position, the printing press is able to start operating or printing again. While operating, the table 36 with all of the plates 13–22 in the lower position can be shifted a distance A/2 in a direction opposite to the first direction of arrow 42′ to the position illustrated in FIG. 5 with the free plates 13, 15, 17, 19 and 21 ready to receive new carriages.

Figure 6:
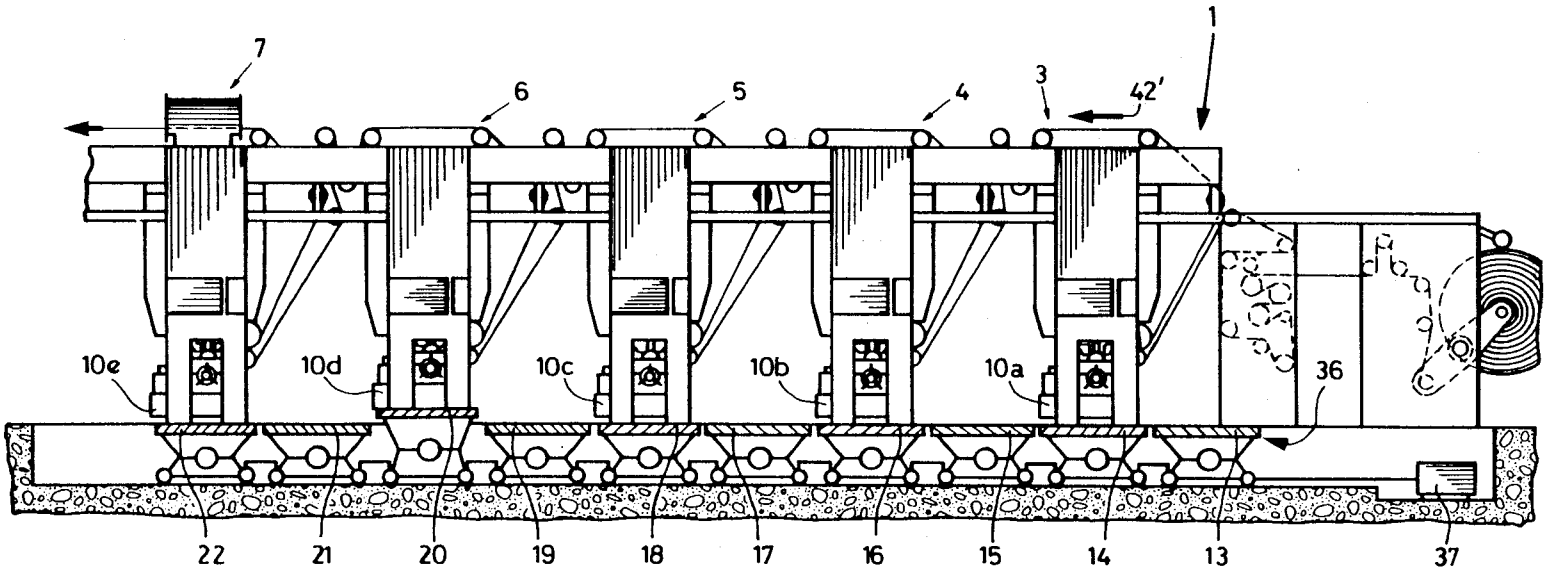
Figure 7:
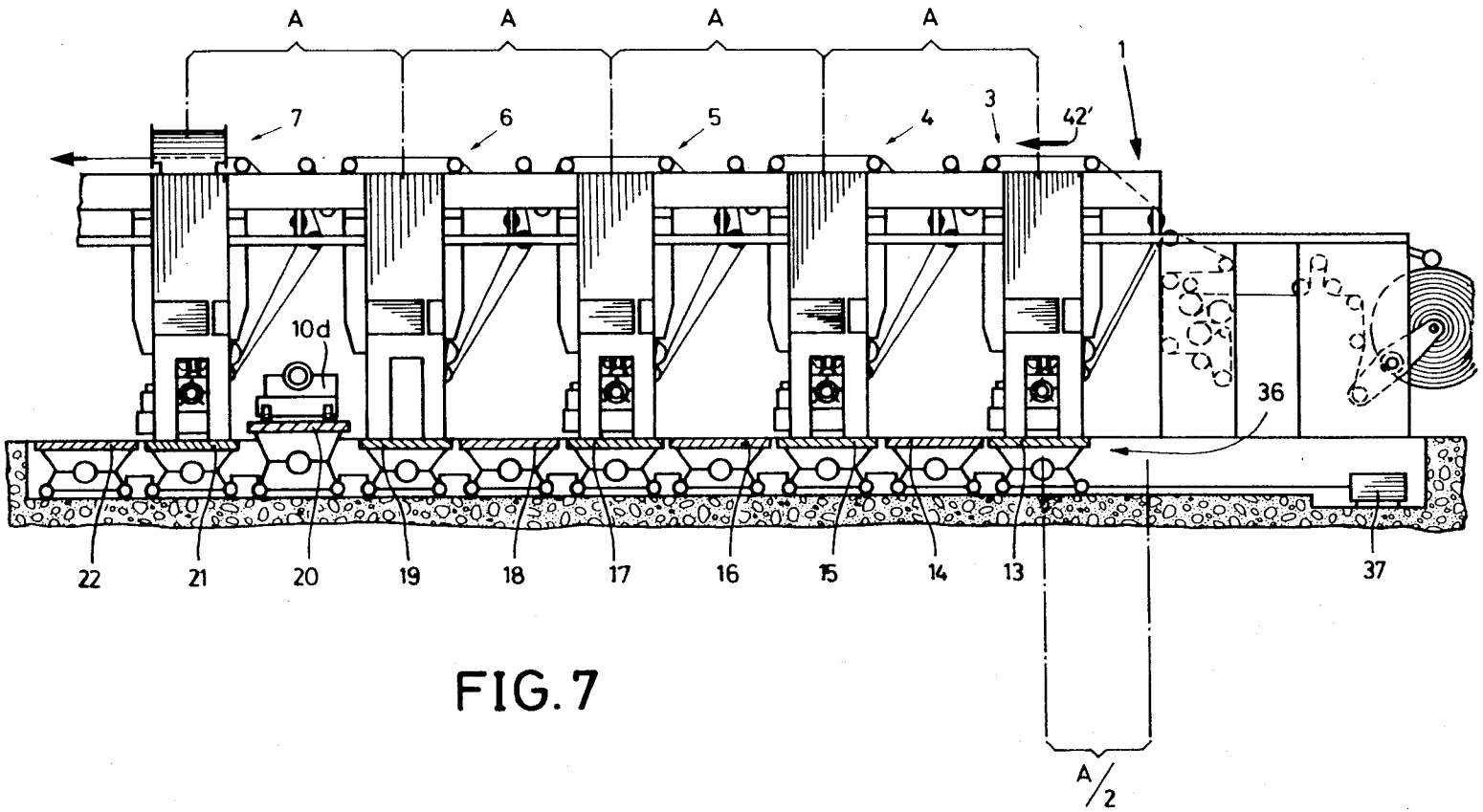
Figure 8:
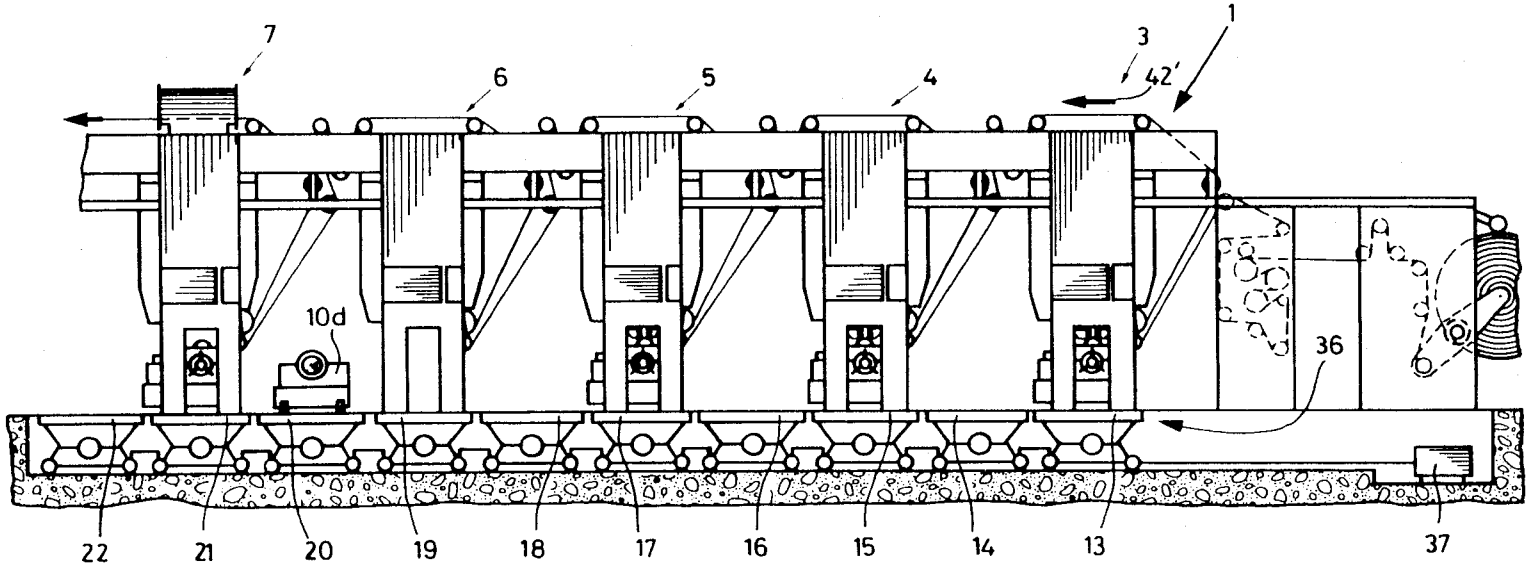

Sometimes in the middle of a printing operation the operator has to adjust, clean or make some changes in one of the printing elements of one of the units. As illustrated in FIGS. 6–8, this can be accomplished for a carriage such as 10*d* containing the engraved cylinder. The printing press is stopped and the plate 20 is individually raised as illustrated in FIG. 6 to the upper level. The raised table 36 is then shifted by the action of the command drive device 37 by a distance A/2 in the first direction of arrow 42'. During this shifting motion, only the plate 20 was in the lifted position and thus only the carriage 10*d* was shifted as illustrated in FIG. 7. After the shifting, the plate 20 can be shifted back to the lower level and the carriage supporting the engraving cylinder 10*d* is withdrawn from the press to proceed with its adjustment or any other operation. Then it is re-positioned into the machine again by being shifted back onto the plate 20 as illustrated in FIG. 8. Subsequently, the plate 20 is lifted to the upper level and the entire table 36 is shifted by the control drive device 37 in an amount A/2 in the second direction which is opposite to the direction 42' to position the carriage back in the initial position as illustrated in FIG. 6. Subsequently the plate is lowered to the first position to reset the carriage 10*d* containing the cylinder in the unit 6.

Figure 9:
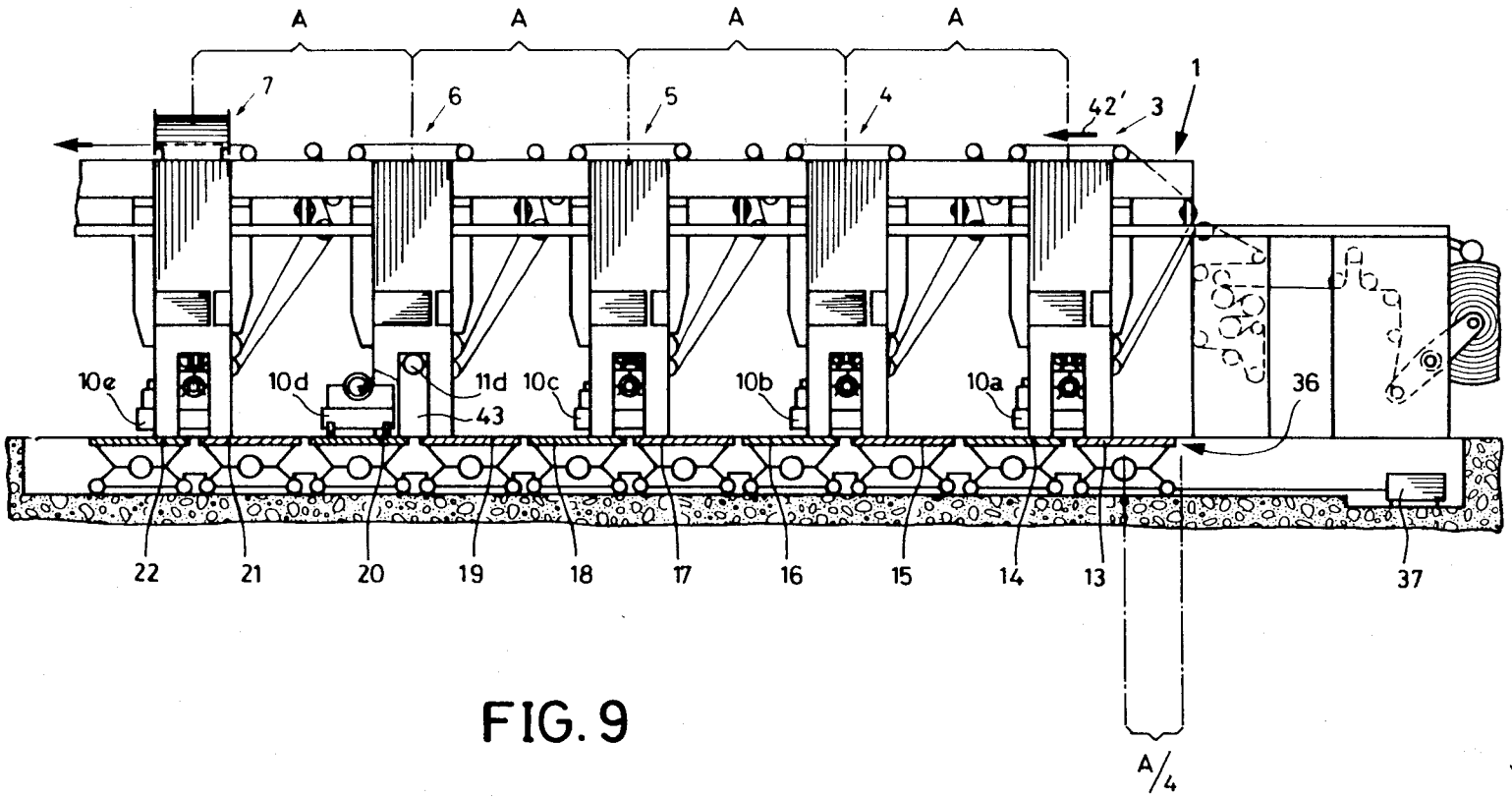

It is also sometimes necessary to exchange a single pressure roll in one of the units such as the unit 6 as illustrated in FIG. 9. To accomplish this, the plate 20 which was positioned under the carriage 10*d* as illustrated in FIG. 6 is raised to the upper position and shifted in the first direction a distance A/4 and then lowered to the position illustrated in FIG. 9. This enables the pressure roll 11*d* of the unit 6 to be removed through the aperture 43 by inserting a trolley such as 44 to receive the pressure and to carry it out of the printing press 1. After the trolley has removed the roll 11*d*, a trolley supporting a new roll is then inserted into the aperture 43 to a position to enable the new pressure roll to be coupled into the position occupied by the roll 11*d*. After exchanging the rolls, the plate 20 is raised to the upper level and then the table 36 is shifted into the second direction which is opposite to the first direction 42' by a distance A/4 to position carriage containing the roll 10*d* back to the position illustrated in FIG. 6 at which time the plate 20 is lowered to the lower position to set the carriage in the desired position. Subsequently the machine can then be started to continue printing.

Figure 10:
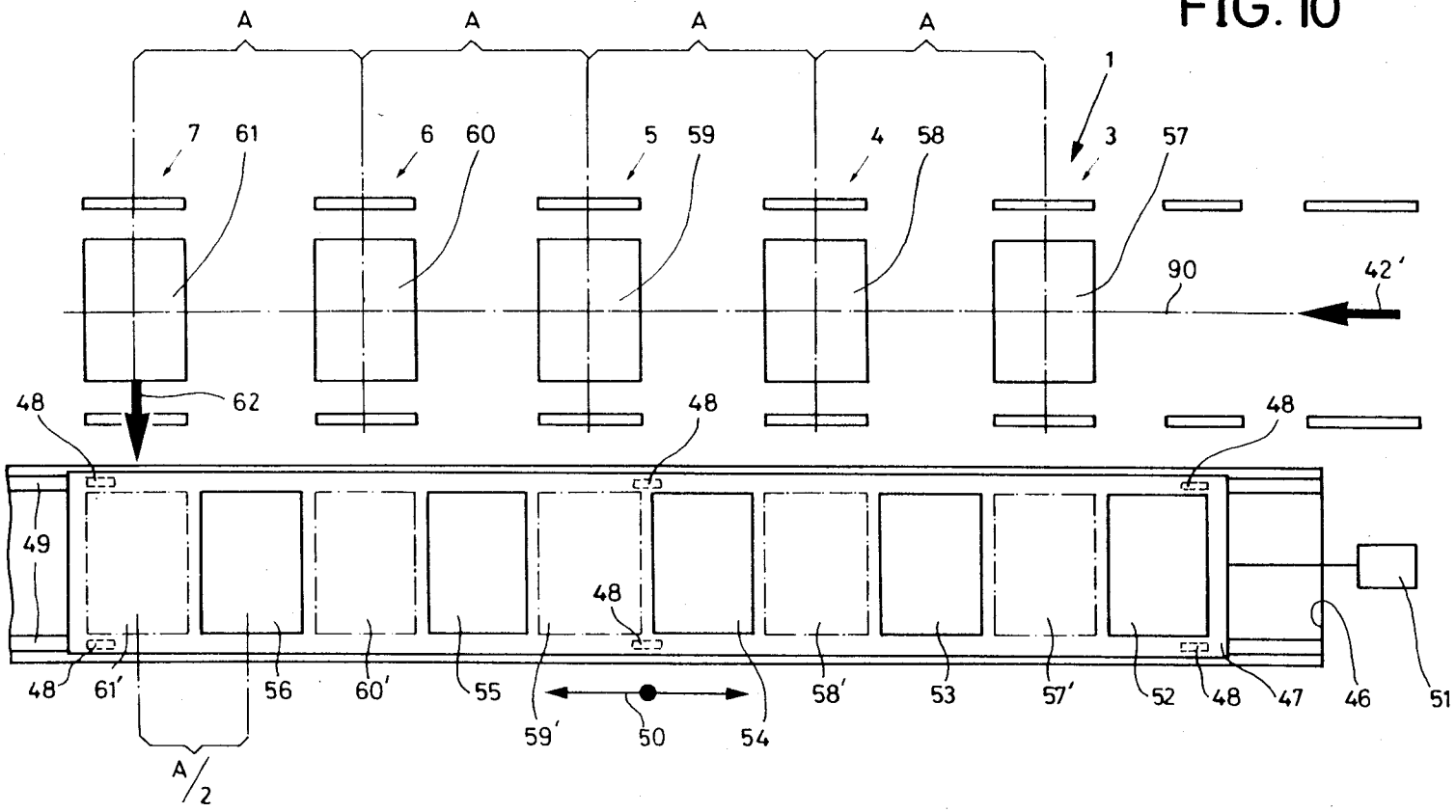
FIG. 10 is a diagrammatical top plan view illustrating another embodiment of changing arrangement or device in accordance with the present invention.
Figure 11:
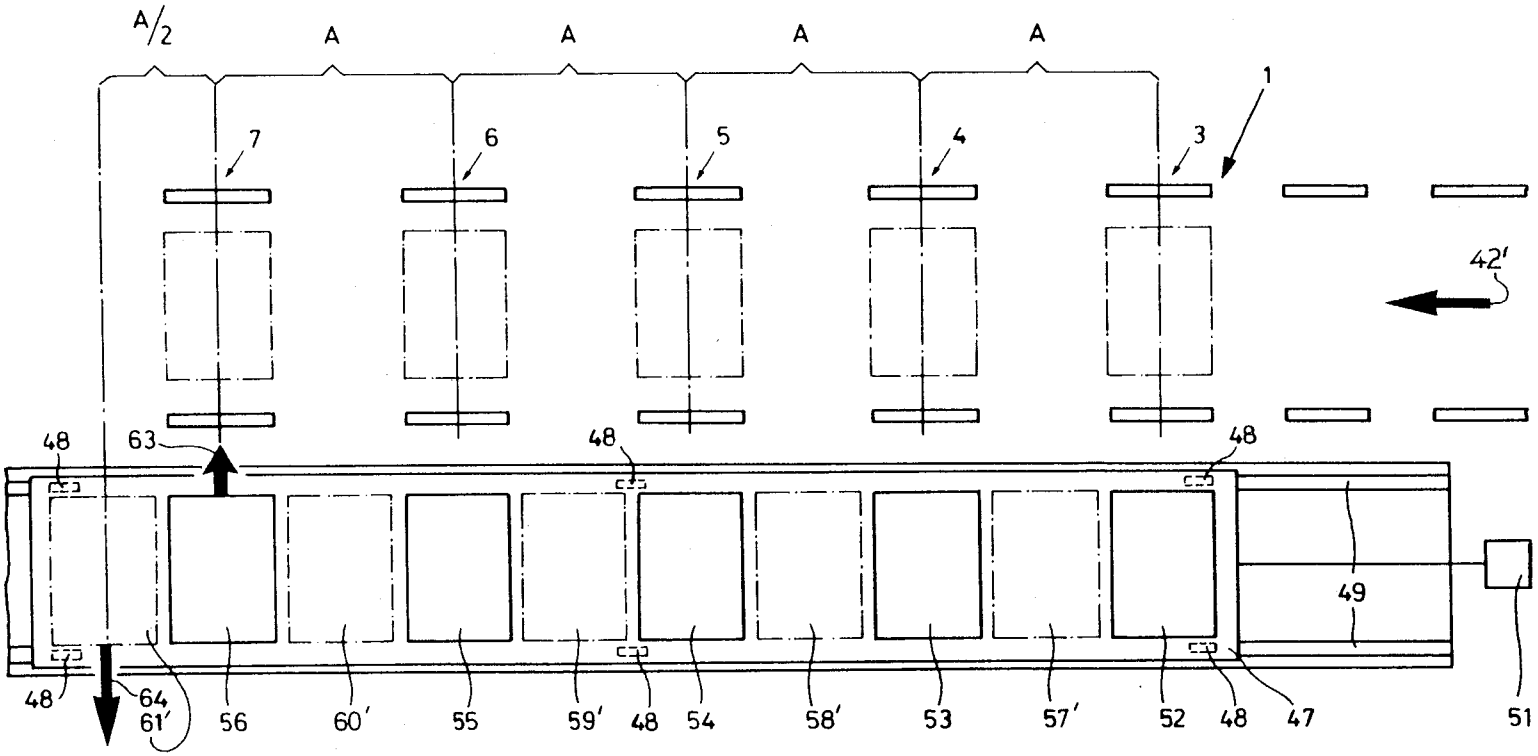
FIG. 11 is a diagrammatic top plan view of the embodiment of FIG. 10 in a second position during changing operation.

FIGS. 10 and 11 schematically show a second embodiment according to the present invention. In both these Figures, the press 1 is shown schematically in a top plan view. The second embodiment has the pit 46, which looks similar to the pit 12 of FIG. 1, and it extends parallel to the press 1. A table 47 similar to table 36 is arranged in the pit 46 and the table 47 is provided on its lower part with rollers 48 which roll on a rolling path 49 situated in the bottom of the pit 46. Shifting of the table 47 in a reciprical manner along the direction of the double arrow 50 is obtained by the control drive device 51. It should be noted, that the roller path 49 can also be laid directly on the floor and in that case construction of the carriage and the trolleys has to be modified. The table 47 is provided with a withdrawable or disengageable centering device, which is not illustrated, and which device engages each of the carriages 52–56 which carriages support a new set of engraving cylinders. During the positioning of the carriages 52–56, the printing press 1 can still be operating. Once the printing job is finished, the press is stopped. The carriages 57 to 61, which are supporting the old engraving cylinders, are removed in the direction of arrows 62 from the position in each of the printing units to positions off the machine and on the table 47 which positions 57'–61' are shown in dotted lines. The table is then shifted in a first direction of the arrow 42' by a distance A/2 which position is illustrated in FIG. 11. Thus, the carriages 52 to 56 supporting the new set of engraving cylinders are positioned in front of the printing units 3–7. Then the carriages 52 to 56 are inserted in the proper printing units 3–7 by shifting them in the direction 63 (FIG. 11). Now the press can be started again while the old set of cylinders in the positions 57'–61' are cleaned and adjusted while positioned on the table 47 or taken off of the table for instance by being withdrawn in a direction of the arrow 64 into a maintenance room. As soon as the engraved cylinders on these carriages that were in the position 57'–61' are ready for a new job, they are simply repositioned as before on the table 47. After being repositioned, the carriage exchange operation can again occur but this time the shifting of the table will occur in the opposite direction. If the pressure rolls are to be exchanged, then the table 47 should be shifted by a distance A/4 after the carriages 57–61 have been shifted to the positions 57'–61' this will provide clearance to enable access to each of the pressure rolls. It is also possible to remove the pressure rolls without withdrawing the carriage by using a special trolley for this purpose.

Figure 12:
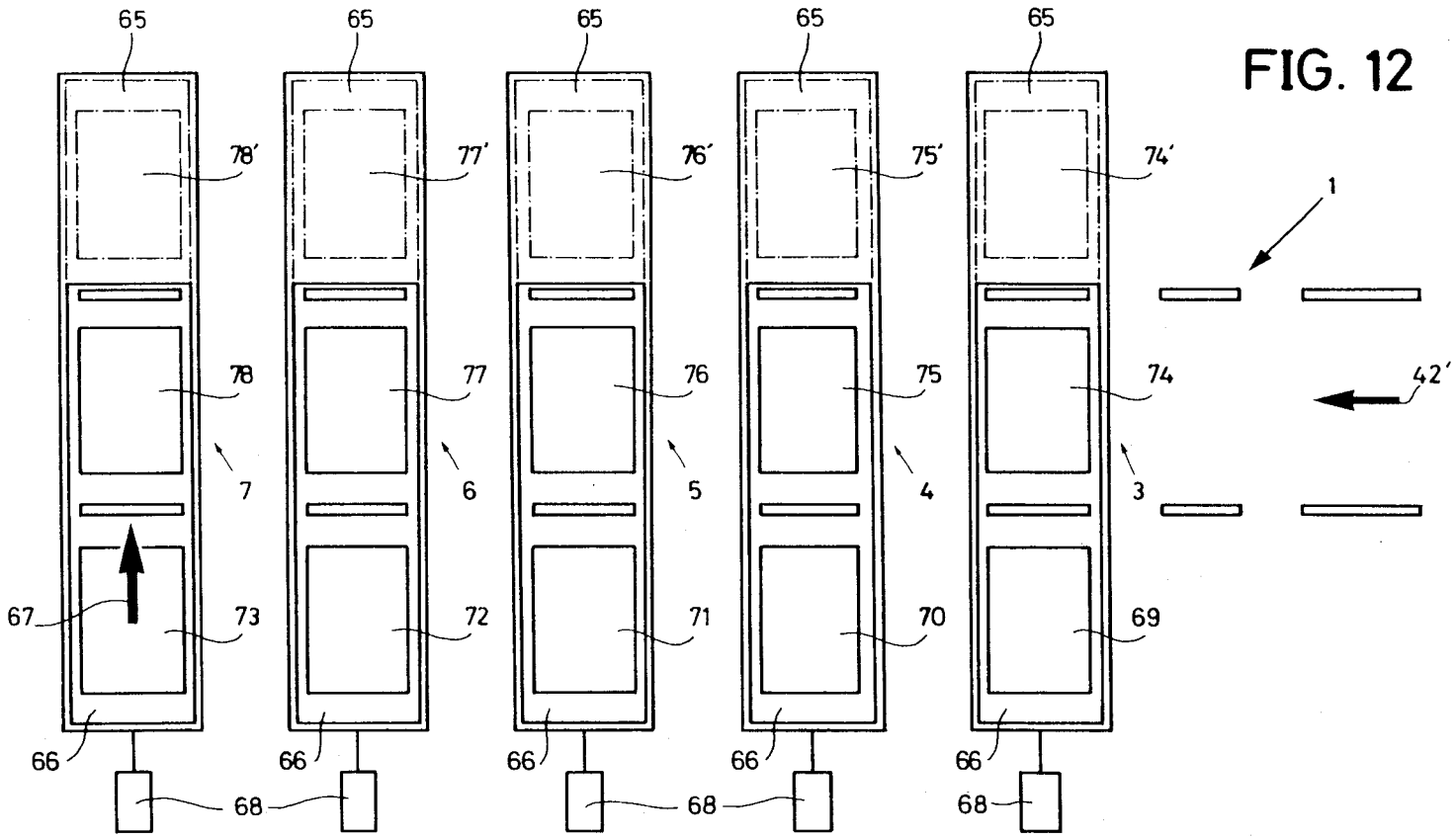
FIG. 12 is a diagrammatical top plan view of a third embodiment of a device for changing the elements of the present invention.
Figure 14:
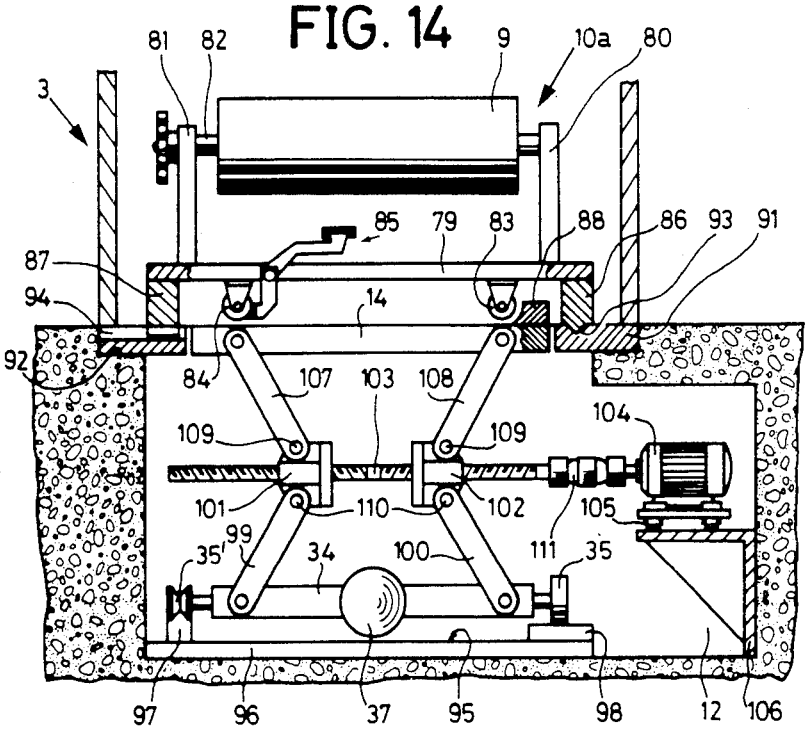
FIG. 14 is a cross-sectional view similar to FIG. 13 illustrating the carriage in a lower position.

A third embodiment of a device for shifting or exchanging carriages is illustrated in FIG. 12 schematically. In this third embodiment, each of the various printing elements in the units 3–7 are exchanged by moving them in a direction 67 which is perpendicular to the direction of the arrow 42'. This is accomplished by providing a separate roller plane 65 beneath each of the units 3–7. The roller plane 65 receives a table 66 which can be shifted by a separate control drive device 68 in a direction of arrow 67 or opposite to this direction. The carriages 69–73, which support a new set of engraving cylinders, are arranged on each of the tables 66, as illustrated in FIG. 12, and the tables 66 already have the carriages 74–78 which have the used cylinders. When the printing press is stopped, each of the tables 66 is shifted in a direction indicated by the arrow 67 and thus the carriages 74–78 will be moved to the positions 74'–78' (shown in dot-dash lines). It should be noted that the carriages 69–73 were moved to the positions previously held by the carriages 74–78 and support the cylinders in each of the printing units 3–7. After this movement, the press can now be started again to execute a new printing job. This type of embodiment requires a drive device for each of the printing units which will allow passage of the carriers 74–78 supporting the engraving elements through the lateral sides of the printing units. This can only be done easily if each unit has an independent drive motor or if the driving system that is used can be disengaged at the location of each printing unit 3–7. The exchange of pressure rolls only requires the removal of the carriages 74–78 out of their respective printing units 3–7 by the shifting table 66 and replacing the carriages 69–73 with trolleys for engaging the pressure rolls. After removal of the previous carriages 74–78, a new trolley is inserted in their position and then the tables are shifted in a direction opposite the arrows 67 to present the new pressure roll. The trolley containing each of the old pressure rolls is removed and replaced with carriages such as 69–73 having the new printing cylinders. It should be noted, that each of the tables 66 and each of the two positions contain removable centering arrangement to insure the correct position of each of the various printing elements such as the carriage containing the engraved cylinder.

Figure 13:
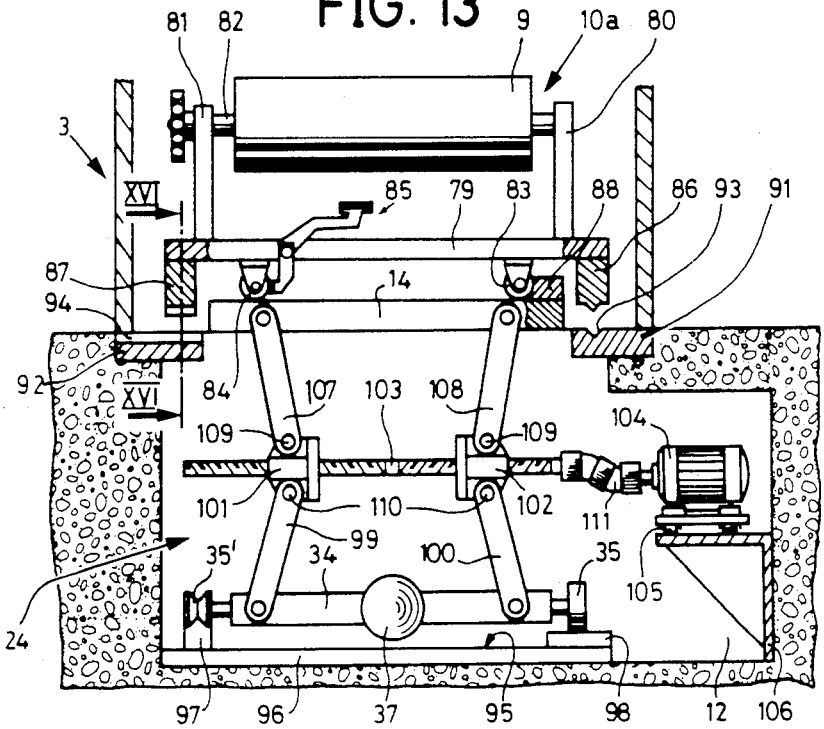
FIG. 13 is a transverse cross-sectional view with portions in elevation for purposes of illustration of one of the carriages on a table of the device of FIG. 1 with the table in elevated position.
Figure 15:
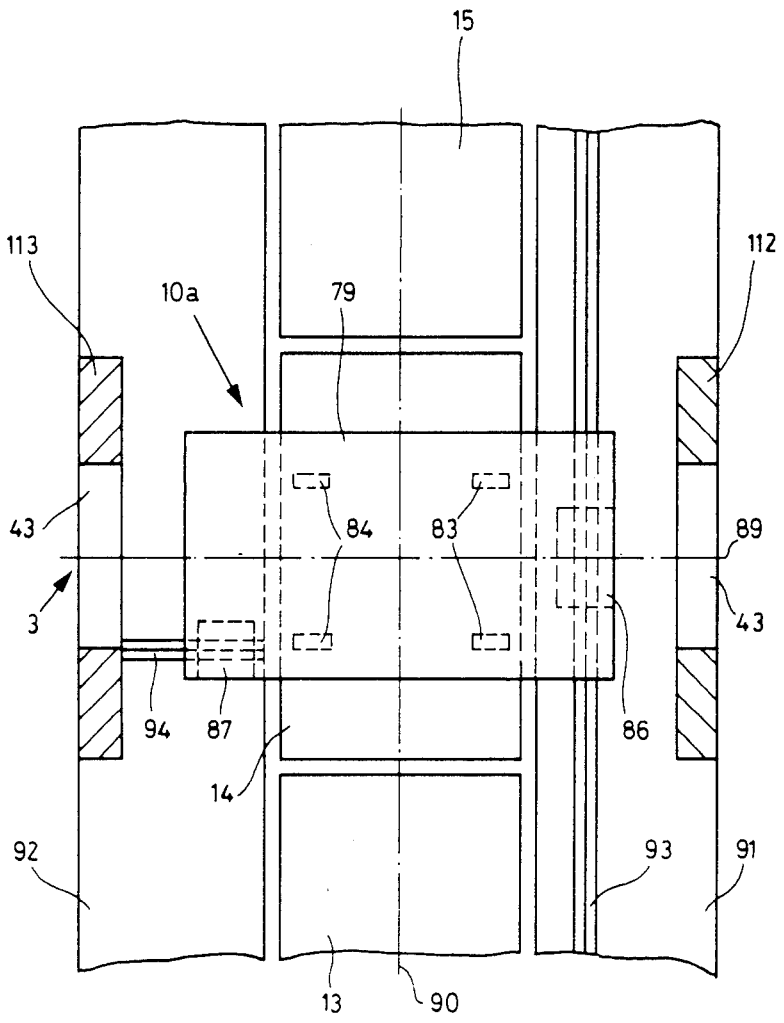
FIG. 15 is a diagrammatical cross-sectional view looking down on a base of the carriage or a table of the device of FIG. 1.

Each of the carriages such as the carriage 10*a* which supports a cylinder 9 has a base member 79 (FIG. 13) with two upstanding supports 80 and 81. Each of the supports 80 and 81 is provided with a bearing (not shown) which supports the two ends of the axle 82 of the engraved cylinder 9. The base member 79 is provided with wheels 83 and 84 and with a locking device 85 which acts on the wheels 84. In addition, the base 79 is provided with centering blocks 86 and 87. When in an elevated position as illustrated in FIG. 13, the wheels 83 and 84 will be engaged on an upper surface of a plate 14 which is provided with a precentering stop or block 88 which will insure the correct position of the carriage 10*a*, which supports the engraving cylinder, according to two perpendicularly extending theoretical axes 89 and 90 (FIG. 15). The carriage 10*a* is to be centered on the theoretical axis 89 of each of the plates 13 to 22 as well as on the medium theoretical axis 90 of the printing press 1.

The pit 12 contains a lifting arrangement or means 23–32 and has two centering strips 91 and 92 on its upper edges. The centering strip 91 is machined with a V-shaped groove 93 into which a centering block 86 can be engaged and this assures a lateral positioning of the carriage 10*a* supporting the engraved cylinder. The centering strip 92 is also machined with V-shaped grooves 94 which extend perpendicular to the groove 93 and which receive the centering block 87 to provide a positioning in the longitudinal direction or on the axes 89 as best illustrated in FIG. 15. During the shifting of the carriage, the centering blocks 86 and 87 must be disengaged from the respective grooves and this is accomplished by the lifting means such as 23 lifting the plate 14 to the position illustrated in FIG. 13.

The lifting device such as 24 for the plate 14 includes a base 34 provided with two sets of rollers 35 and 35'. As illustrated, the set 35' has a V-shaped groove machined therein while the other set 35 are without grooves. The guide plane 95 is made of an iron sheet equipped with a V-shaped rail 97 and a flat rail 98 and the guide plane is used for guiding the varying lifting means 23–32 for the plates 13–22 when the table 36 is shifted in a lengthwise direction by the controlled drive 37. The base 34 has pivotally mounted thereon lower arms 99 and 100 whose opposite ends are pivotally secured by pins 110 in threaded bearings 101 and 102 respectively. The bearings 101 and 102 are received on a screw member 103 which has a left hand worm or threads for the bearing 101 and right hand threads for the bearing 102. The screw 103 is rotated by a motor 104. The motor 104 of each of the lifting means 23–32 can be operated together or independently according to whether a single plate or all of the plates are to be lifted at the same time. As illustrated, the motor 104 is provided with rollers 105 which are received on a shelf formed by an angle iron arrangement 106. Thus the motor can move along with the plates as the table 36 is shifted. The lifting device also includes the upper arms 107 and 108, which are pivotally mounted by pivot pins 109 to the threaded bearings 101 and 102. The other ends of the arms 107 and 108 are pivotally connected to the table 14. The motor 104 is connected with the screw 103 by a cardan joint 111 which is only schematically illustrated and which allows or compensates for the difference in the height between the axis of the motor 104 in the plate 14 during the lifting and lowering operations. Thus, the screw 103 with the arms 99 and 100 107 and 108 as well as the threaded bearings forms a toggle-type arrangement for raising and lowering the plate 14 from its base 34.

As illustrated in FIG. 15, each of the printing units such as the unit 3 has side frames 112 and 113 which are each provided with the opening or apertures 43. As illustrated in FIG. 15, the upper portions of the carriage are removed for purposes of illustration and thus the base 79 of the carriage 10*a* which is supporting the engraved cylinder is shown on the plate 14 with the guide blocks or centering blocks 86 and 87 positioned for engagement in the respective grooves 93 and 94. This will insure that the carriage is properly centered on the theoretical axis 89 and 90 of the printing unit 3. As best illustrated in FIG. 16 when the plate 14 is in the upper position, the centering blocks are withdrawn from their respective grooves but the wheels such as 84 are resting on the plate 14.

FIG. 17 as mentioned hereinbefore shows the steps of positioning the trolley 44 by inserting it through the apertures such as 43 and one of the side frames such as 113 of the printing unit 3. In the position illustrated in bold lines, the trolley 44 can receive the pressure roll 11*a* as they are removed or disengaged from the printing unit. Subsequently the trolley 44 is moved to the left to the position illustrated in broken lines and subsequently removed further. Another trolley containing a new pressure roller is then inserted through the aperture in the wall 113 to position the new pressure roll in a position for engagement in the press.

As mentioned hereinabove, the second and third embodiments avoid the lifting operation of the plates which is necessary for disengaging the positioning means of the first embodiment; however, the second and third embodiments require special arrangements for the particular driving of the printing elements in each unit.

The advantages offered by the present invention will enable the user of the printing press to prepare all of the printing elements while positioned away from the press. While the press is still running, the various carriages containing these printing elements can be positioned so that as the press is stopped, they can be exchanged with a great reduction in the down time for the press.

Although various minor modifications may be suggested by those versed in the art, it should be understood that I wish to embody within the scope of the patent granted hereon, all such modifications as reasonably and properly come within the scope of my contribution to the art.

I claim:

1. A method for changing the printing elements in printing units of a printing press which units are spaced a distance A from each other, said method comprising the steps of providing a table composed of a plurality of interlocked plates beneath each of the carriages in each unit, said table having two plates for each unit and means for separating raising each of said plates, positioning a carriage containing a new engraving cylinder on each empty plate while the adjacent plate is positioned beneath a carriage in each unit; stopping the press, lifting all of the plates from a lower position to an upper position to disengage each of the carriages from the printing unit; shifting the lifted plates in a first direction by a distance equal to one-fourth of the distance between the units; lowering the plates to a lower position; positioning trolleys to extend into apertures in a side frame to receive a pressure roll of each unit; removing the pressure roll on the trolley; inserting a new trolley containing a new pressure roll to position the new pressure roll in each unit; subsequently after exchanging the pressure rolls, raising each of the plates to the upper level; shifting the units in the first direction another one-fourth of the distance between the printing units; lowering the raised plates so that the carriages containing the new engraved cylinders are positioned in each of said units; and then starting the press again to continue printing.

2. A method according to claim 1, wherein the step of lifting and lowering each of the plates is individually accomplished.

3. A method according to claim 1, wherein the carriages shifted out of each of the units are subsequently removed from their respective plates and the table is shifted back to the initial position.

4. A device for exchanging carriers containing engraved cylinders for each printing unit of a press having at least two spaced-apart units acting on a web moving through the press, said device including a table, said table being composed of a plurality of plates with two plates for each of said printing units of the press, said table being reciprocally movable along a linear path extending in a direction parallel to the direction of movement of the web with the table being underneath the press, each of said plates being positionable for receiving a carriage and having lifting means for individually moving the plate between a lower position and an upper position to permit carriage exchange at said unit, shifting means for reciprocally moving said table along said linear path, and means for guiding the table as it is being moved along said path.

5. A device according to claim 4, wherein each of the lifting means can be individually operated.

6. A device according to claim 4, wherein each of the lifting means can be simultaneously operated to move all of the plates simultaneously between said positions.

7. A device according to claim 4, wherein the shifting means comprises a double action pneumatic piston.

8. A device according to claim 4, wherein each of the lifting means comprises a toggle arrangement.

9. A device according to claim 8, wherein each of the toggle arrangements comprises a pair of pivot arms pivotally connected to the plate, the other ends of said pivot arms being pivotally connected to threaded bearings received on a screw having a portion with a right-handed thread and a portion with a left-handed thread, each of said threaded bearings being pivotally connected to a second group of arms pivotally connected to a base of the toggle arrangement so that rotation of the screw in one direction causes the plate to be moved to the upper position while rotation of the screw in the opposite direction lowers the plate to the lower position.

* * * * *